US007954355B2

(12) United States Patent
Fontaneto

(10) Patent No.: US 7,954,355 B2
(45) Date of Patent: Jun. 7, 2011

(54) DEVICE FOR AUTOMATICALLY ADJUSTING CONTROL CAMS IN A FORGING MACHINE

(75) Inventor: Enzo Fontaneto, Borgo Manero (IT)

(73) Assignee: Sacma Limbiate S.p.A., Limbiate (IT)

( * ) Notice: Subject to any disclaimer, the term of this patent is extended or adjusted under 35 U.S.C. 154(b) by 501 days.

(21) Appl. No.: 12/070,316

(22) Filed: Feb. 14, 2008

(65) Prior Publication Data

US 2008/0202194 A1 Aug. 28, 2008

(30) Foreign Application Priority Data

Feb. 14, 2007 (IT) ..... MI2007A0269

(51) Int. Cl.
*B21J 13/08* (2006.01)
*B21D 45/02* (2006.01)

(52) U.S. Cl. ..... 72/405.12; 74/568 R; 470/154; 72/452.5

(58) Field of Classification Search ..... 72/452.4, 72/452.5, 405.9, 405.11, 405.12; 470/95, 470/109, 154; 74/568 R
See application file for complete search history.

(56) References Cited

U.S. PATENT DOCUMENTS 4,344,312 A * 8/1982 Flamme et al. ..... 72/452.7
5,666,838 A * 9/1997 Dudick et al. ..... 72/14.8
5,732,589 A * 3/1998 McClellan et al. ..... 72/405.12
6,446,479 B1 * 9/2002 Garlaschi ..... 72/361

* cited by examiner

*Primary Examiner* — David B Jones
(74) *Attorney, Agent, or Firm* — Kirschstein, et al.

(57) ABSTRACT

In a device for automatically adjusting the control cams of a forging machine, with a releasing means for releasing the operating position of a cam, the cam supporting shaft swingably supports, with a controlled movement with respect to the shaft longitudinal axis, radially extending brackets, in turn supporting a bar extending through the overall length of the control cam supporting shaft, the brackets being moreover provided, at each control cam, with cylinder-piston units including movable pins which can be engaged with recesses formed in the cams.

7 Claims, 6 Drawing Sheets

DEVICE FOR AUTOMATICALLY ADJUSTING CONTROL CAMS IN A FORGING MACHINE

BACKGROUND OF THE INVENTION

The present invention relates to a device for automatically adjusting control cams in a forging machine.

As is known, in forging machines for cold forging metal workpieces, are conventionally used grippers which can be opened and closed in a controlled manner, to provide an automatized transfer of the workpieces from a forging station to another forging station. The grippers are opened by gripper operating control cams supported by a rotary shaft.

For changing the production mode of operation of the machine, for example to make workpieces of different shapes, it is necessary to adjust the angular positions of the above mentioned cams, to properly fit them to the opening and closing movement of the workpiece transfer grippers.

At present, the above mentioned adjustment of the control cams, in the most part of metal workpiece forging machines, is manually performed by a machine operator and, to that end, the machine operator must sometime access the space between the punches and dies of the machines, which is a disadvantageous position from an ergonomic standpoint.

A device for automatically adjusting control cams controlling the opening and closing movements of the transfer grippers in a forging machine of the above mentioned type is already known. Such prior mechanism, however, comprises several mechanical components and auxiliary devices, thereby the prior machine is subjected to undesirable mechanical malfunctions, related to the opening, respectively closing, of the workpiece transfer grippers.

SUMMARY OF THE INVENTION

Accordingly, the aim of the invention is to overcome the above mentioned drawbacks affecting the prior art and provide simple means allowing to accurately and automatically adjust the control cams used for opening respectively closing the workpiece transfer grippers.

According to the present invention, the above aim is achieved by a device for automatically adjusting control cams in a forging machine, including means for releasing an operating position of said cams, in which a cam supporting shaft swingably supports, and with a controlled movement with respect to the shaft longitudinal axis, radially extending brackets, said brackets supporting a bar extending through the overall length of said control cam supporting shaft and in which, moreover, at each said control cam, said bar comprises cylinder-piston unit including movable pins which can be engaged with recesses formed in said cams.

Further advantages of the present invention will become more apparent from the dependent claims, the following disclosure and the accompanying drawings.

BRIEF DESCRIPTION OF THE DRAWINGS

The subject matter according to the present invention will be disclosed in a more detailed manner hereinafter with reference to an exemplary embodiment thereof, shown in the accompanying drawings, where.

DESCRIPTION OF THE PREFERRED EMBODIMENT

Figure 1:
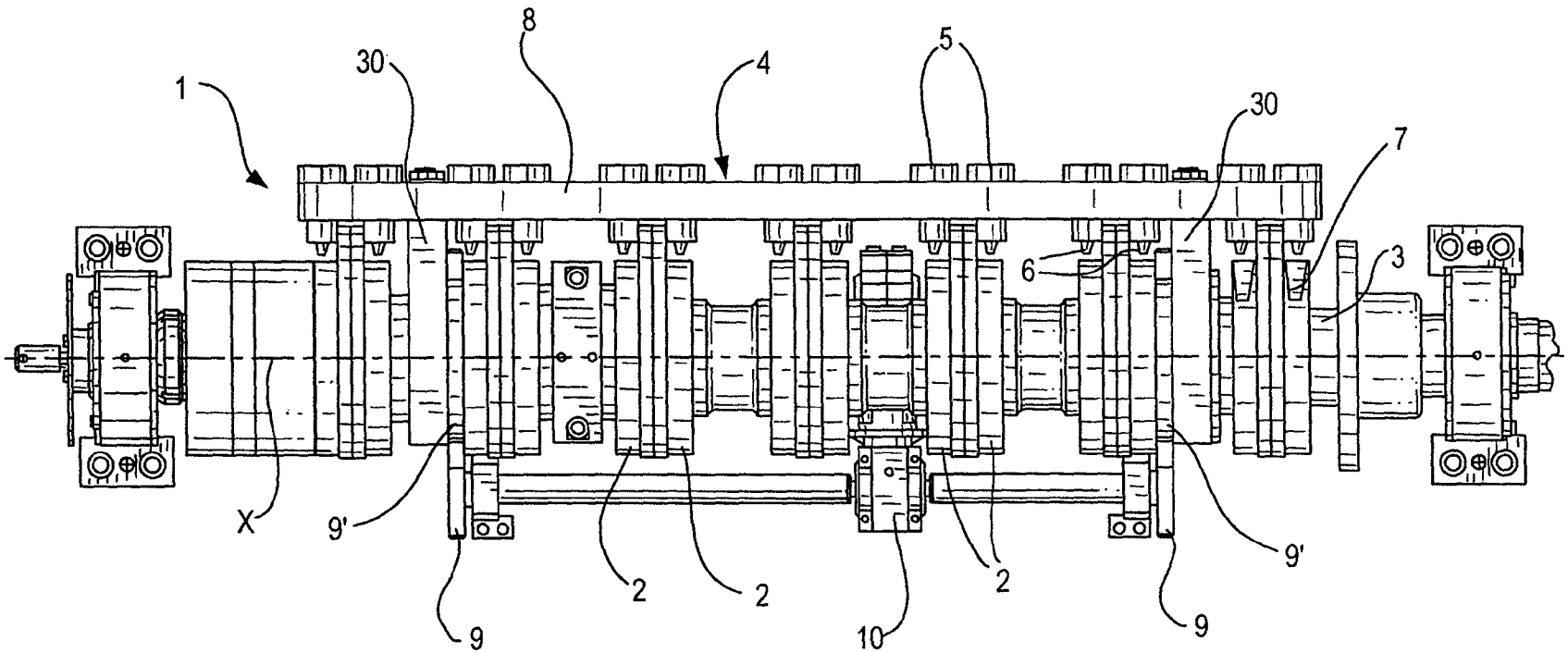
FIG. 1 is a view showing the cam adjusting device according to the invention.

As shown in FIG. 1, in a cam adjusting mechanism 1, a plurality of adjusting cams 2, for adjusting the opening, respective closing, of workpiece transfer grippers (not shown), are supported, in a per se known manner, by a driven shaft 3. With said cams 2, a device, generally indicated by the reference number 4, supporting controllable cylinder-piston unit 5 is associated.

Figure 2:
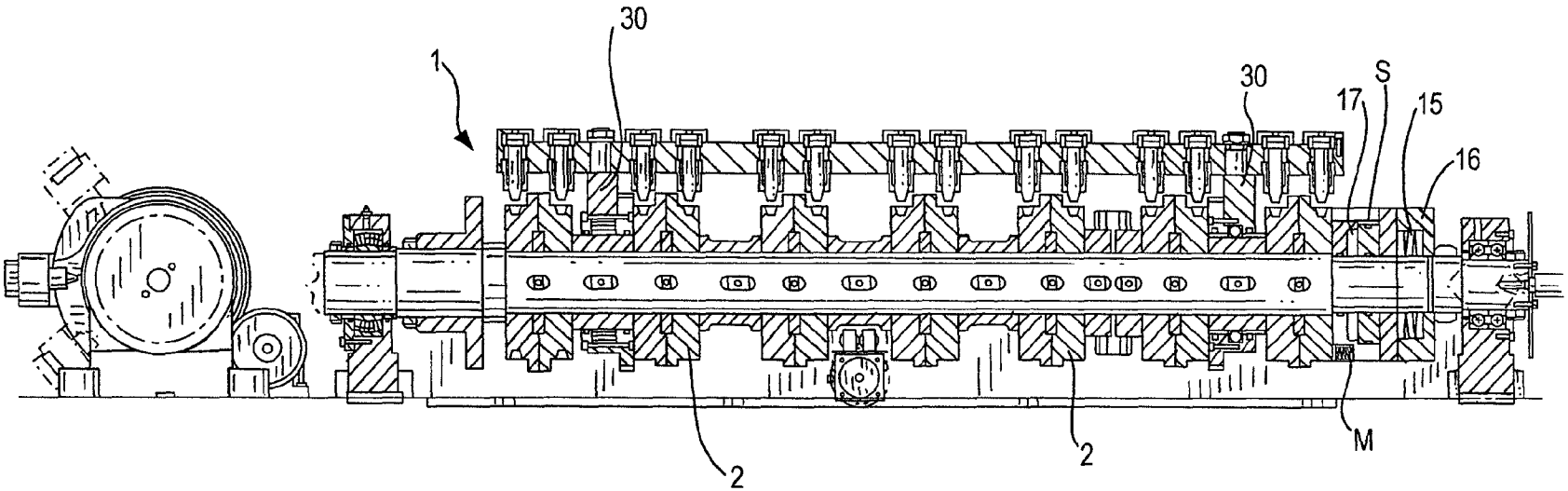
FIG. 2 is a cross-sectional view showing the device or mechanism of FIG. 1.

Said cylinder-piston unit 5, in particular, are so designed as to carry a plurality of pins 6 from a rest position, shown in FIGS. 1 and 2, to operating positions thereat said pins are engaged in locking openings 7 formed in the bodies of the cams 2, to be arranged with respect to the shaft 3.

The cylinder-piston units 5 are mounted on a bar 8, extending in parallel to the shaft 3, and which is supported by brackets 30, through gears 9, 9', a controllable driving mechanism 10 allowing to drive the bar 8 with a swinging movement with respect to the axis X of the main shaft 3.

FIG. 2 is a longitudinal cross-sectional view of the device 1. In this figure it is moreover shown that all the control cams 2 are held, by friction, at an operating or working position, owing to the provision of a pack or assembly of cup springs, indicated by the reference number 15, providing an axial force on said cams through a plurality of pins S.

The body 16 locking under preload the cup springs 15 is operatively coupled to a cylinder-piston unit 17 allowing to neutralize the operation of the cup springs.

Figure 3:
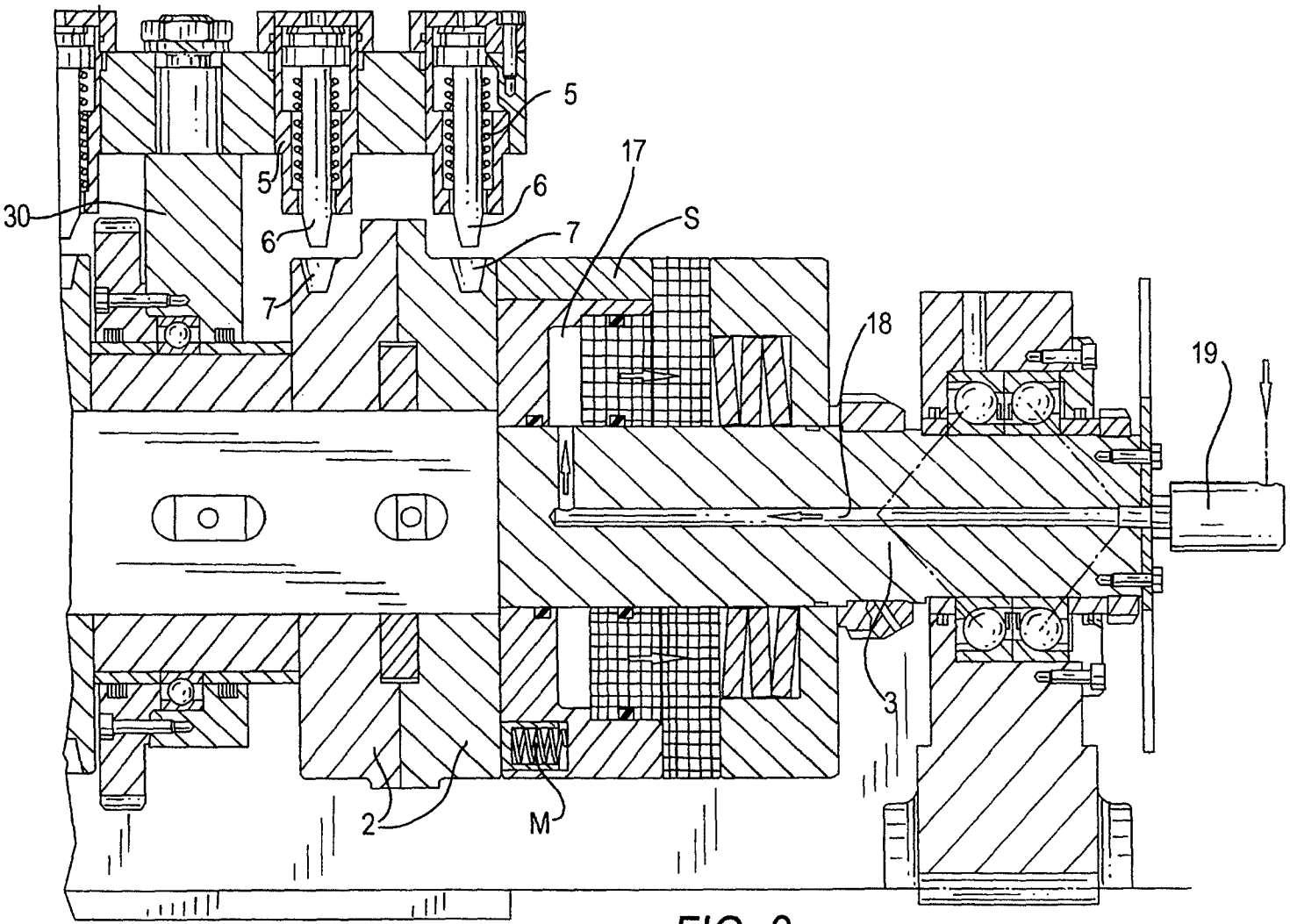
FIG. 3 shows a detail of the adjusting device according to the invention.

FIG. 3 shows that the cylinder-piston unit 17 is controlled through a duct 18 formed in the shaft 3 and to which a pressurized fluid is supplied to a rotary coupling 19, to provide an operating pressure inside said cylinder-piston unit 17.

A plurality of springs M operate to provide an axial pushing force on the cams, said force being sufficient to prevent said cams from being accidentally displaced as the angular position thereof is adjusted.

Figure 4:
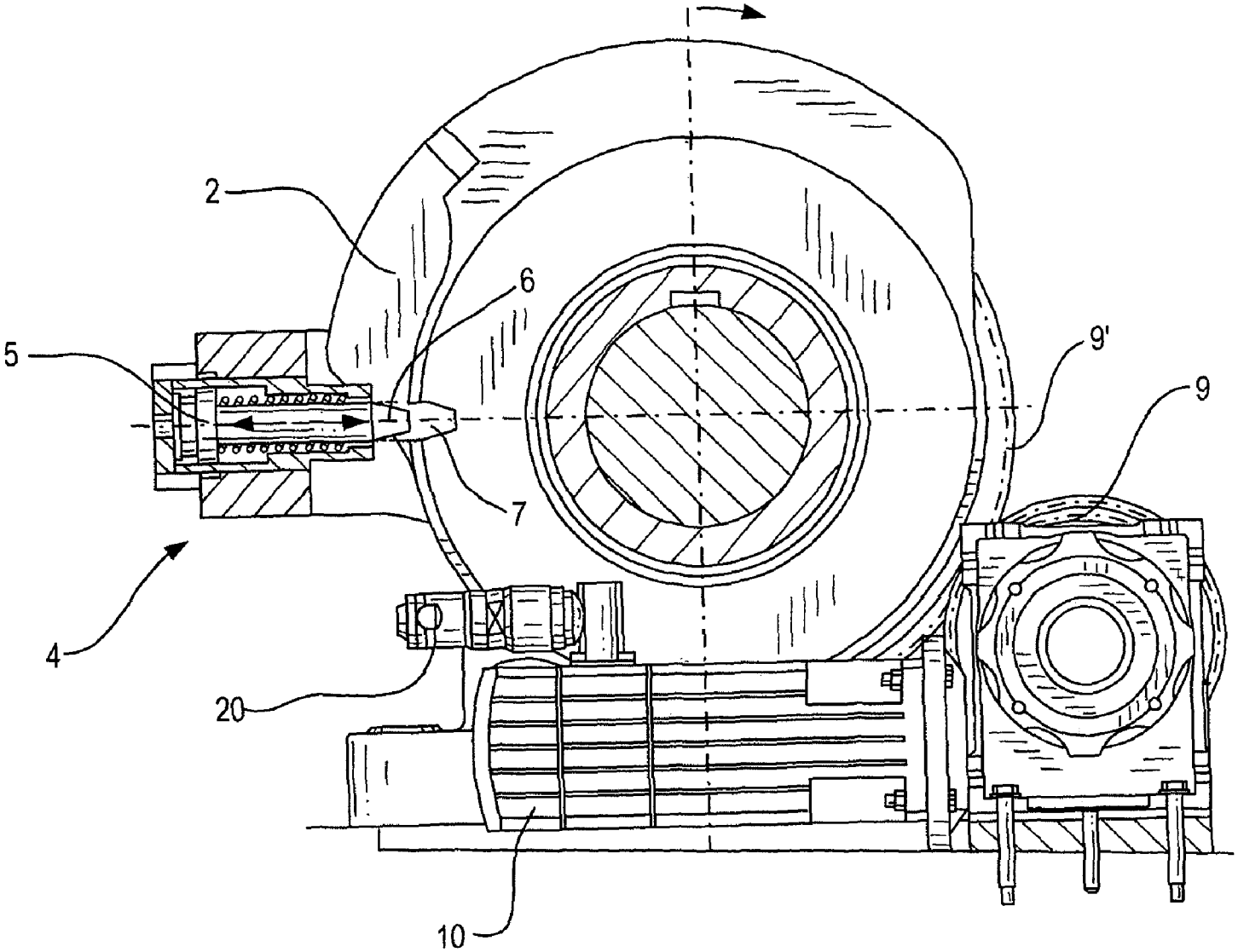
FIG. 4 is a view showing a mechanism for arranging the control cams in an adjusting step.

FIG. 4 shows a cam 2 and the related bar 4 receiving a cylinder-piston unit 5, the locking stem 6 of which can be engaged in the recess 7 of the cam, said FIG. 4 showing moreover the gear 9 and 9' mechanism and related driving motor 10.

Advantageously, the driving motor 10 is associated with a control means 20, for example an encoder or like control element, thereby controlling the driving motor 10 and accordingly the movement transmitted to the can driving gear 9.

Figure 5:
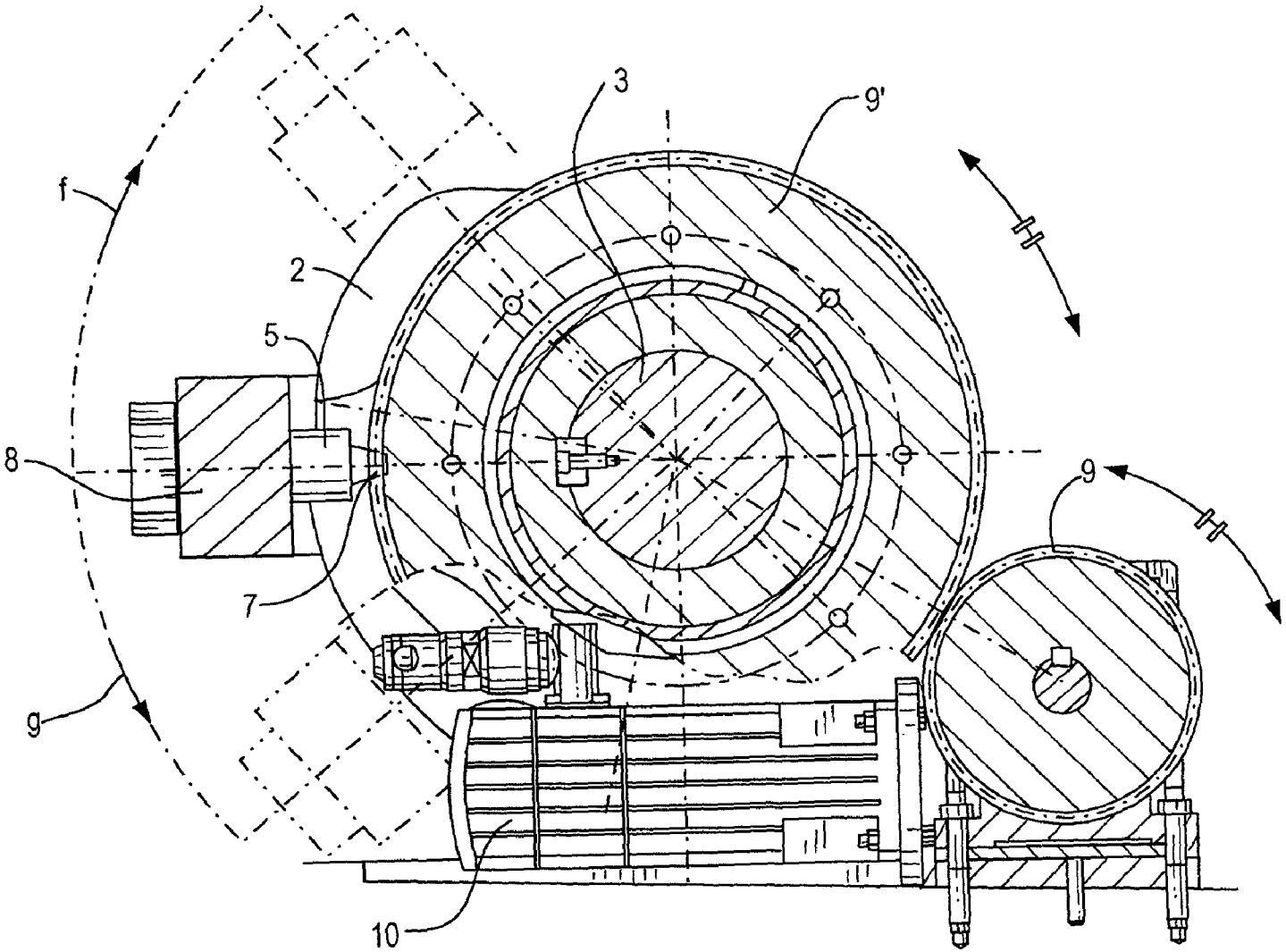
FIG. 5 is a cross-sectional view showing the mechanism of FIG. 4.

FIG. 5 shows that, by driving the gear 9, as controlled by the controllable motor 10, it is possible to operate the bracket 30 rotating gears 9, 9' to cause the bar 8 to swing, with respect to the shaft 3, in the direction shown by the arrows (f) and (g) in FIG. 5, thereby, as a pin 6 of a selected cylinder-piston unit 5 is engaged in an opening 7, this will drive and angularly locate the selected cam 2, to in turn adjust the movement transmitted by said cam 2.

During the automatic adjustment of the cam 2, the cam supporting shaft 3 is restrained to the mechanical driving elements.

After having adjusted said cams 2, the cam supporting shaft 3 will perform a low speed full revolution, to verify a proper correspondence between the actual position of each individual cam 2 and a set position thereof.

Figure 6:
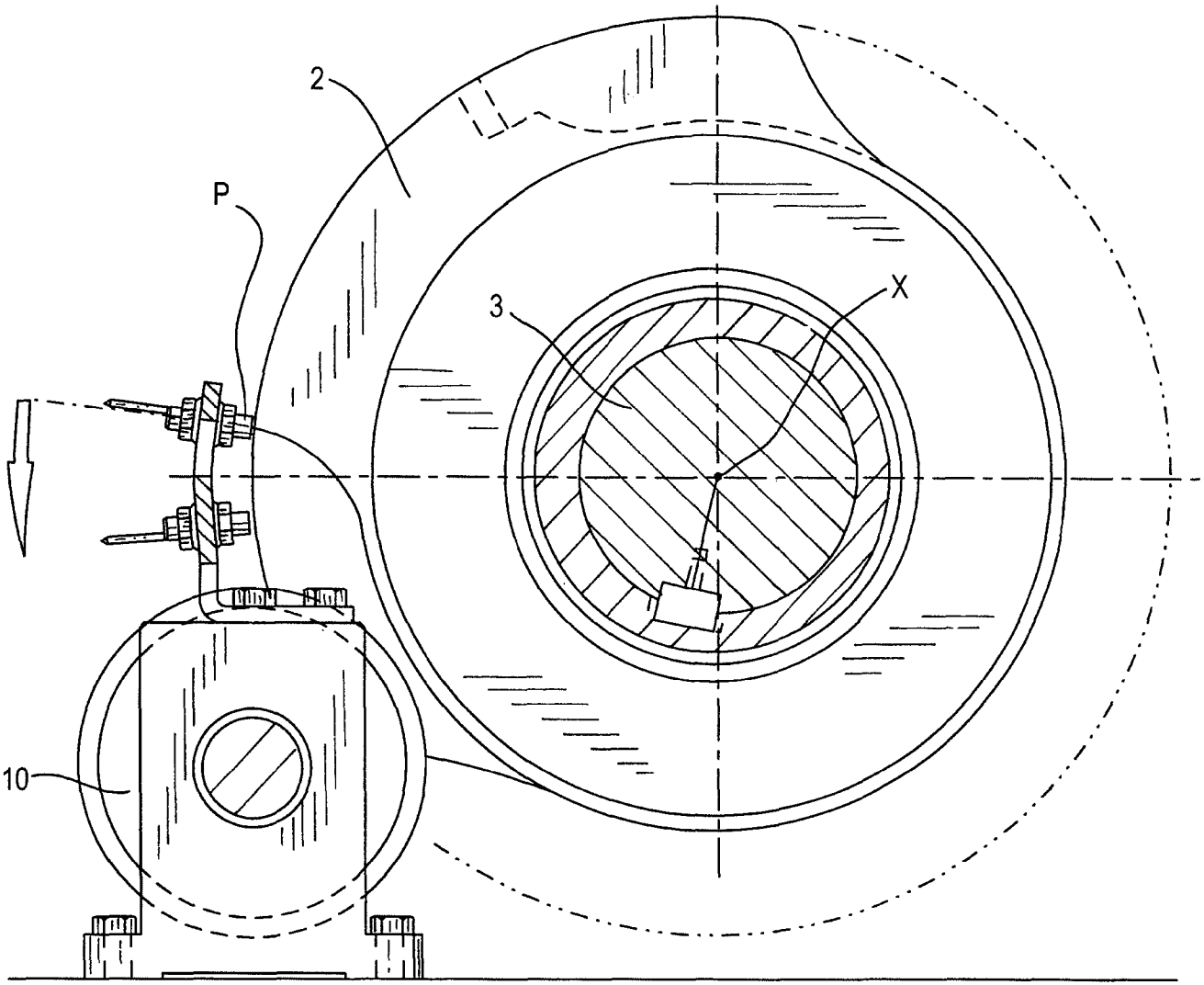
FIG. 6 shows the cam driving shaft with a cam therewith a sensor for sensing the position of the cam is associated.

To that end, each cam 2 comprises a position sensor P (see FIG. 6) to detect the proper angular position of the cams 2.

The invention claimed is:

1. A device for automatically adjusting cam timing in a forging machine, comprising:

a rotary camshaft extending along a cam axis;

a plurality of cams axially arranged on the camshaft for joint rotation therewith, each cam having a plurality of radial recesses angularly arranged apart about the cam axis;

a pair of radial support brackets axially arranged apart on the camshaft;

a movable support bar supported by the support brackets and extending along a bar axis parallel to the cam axis;

a plurality of pressure-operated units mounted on the support bar for joint movement therewith, each pressure-operated unit having a movable pin; and a drive for rotating the support brackets about the cam axis, and for swinging the support bar and the pressure-operated units thereon about the cam axis, until the pin of at least one of the pressure-operated units is positioned in radial alignment with a predetermined one of the recesses of at least one of the cams prior to movement of the pin into the predetermined one recess to lock the one cam in a predetermined angular position on the camshaft.

2. The device according to claim 1, and a spring for pushing the cams together in mutual frictional engagement.

3. The device according to claim 2, and a hydraulic unit for releasing the cams against the pushing of the spring prior to operation of the drive.

4. The device according to claim 3, and a duct extending along the cam axis partly through the camshaft for supplying hydraulic fluid to the hydraulic unit.

5. The device according to claim 1, wherein the drive includes a motor, a set of gears coupled between the motor and each support bracket, and a controller for controlling the motor to rotate the gears by a predetermined angular extent.

6. The device according to claim 1, wherein the drive is operative for swinging the support bar and the pressure-operated units thereon in either circumferential direction about the cam axis.

7. The device according to claim 1, and a position sensor for each cam for sensing an angular position of a respective cam relative to the cam axis.

* * * * *